US012122433B2

(12) United States Patent
Keener

(10) Patent No.: US 12,122,433 B2
(45) Date of Patent: Oct. 22, 2024

(54) CRASH ENERGY MANAGEMENT SYSTEMS FOR CAR COUPLING SYSTEMS OF RAIL CARS

(71) Applicant: Amsted Rail Company, Inc., Chicago, IL (US)

(72) Inventor: Scott A. Keener, Harrisburg, PA (US)

(73) Assignee: Amsted Rail Company, Inc., Chicago, IL (US)

( * ) Notice: Subject to any disclaimer, the term of this patent is extended or adjusted under 35 U.S.C. 154(b) by 881 days.

(21) Appl. No.: 17/161,843

(22) Filed: Jan. 29, 2021

(65) Prior Publication Data

US 2022/0242461 A1 Aug. 4, 2022

(51) Int. Cl.
*B61G 9/18* (2006.01)

(52) U.S. Cl.
CPC ..... *B61G 9/18* (2013.01)

(58) Field of Classification Search
CPC ..... B61G 9/18; B61G 11/16
See application file for complete search history.

(56) References Cited

U.S. PATENT DOCUMENTS

| | | | | |
|---|---|---|---|---|
| 2,436,917 | A * | 3/1948 | Dath | B61G 9/10 267/213 |
| 6,796,448 | B1 * | 9/2004 | Wilt | B61G 7/10 213/40 R |
| 7,708,157 | B2 * | 5/2010 | Kemper | B61G 7/08 213/57 |
| 8,783,479 | B2 * | 7/2014 | Ewerding | B61G 11/16 213/7 |
| 9,290,189 | B2 * | 3/2016 | Kukulski | F16F 7/127 |
| 9,663,122 | B2 | 5/2017 | Watts | |
| 2003/0209915 | A1 * | 11/2003 | Yoshida | F16F 7/125 293/133 |
| 2009/0065462 | A1 | 3/2009 | Gansweidt | |
| 2017/0158211 | A1 | 6/2017 | Bonney | |
| 2022/0242462 | A1 * | 8/2022 | Keener | B61G 11/16 |
| 2022/0242463 | A1 * | 8/2022 | Keener | B61G 11/16 |

FOREIGN PATENT DOCUMENTS

| | | | | |
|---|---|---|---|---|
| DE | 102016205981 | | 10/2017 | |
| EP | 1305199 | A1 * | 5/2003 | B61G 11/16 |
| EP | 1955918 | | 8/2008 | |
| EP | 2687417 | | 1/2014 | |

(Continued)

OTHER PUBLICATIONS

International Preliminary Report on Patentability for PCT/US2021/059824, sent Aug. 10, 2023.

(Continued)

*Primary Examiner* — Scott A Browne
(74) *Attorney, Agent, or Firm* — Joseph M. Butscher; The Small Patent Law Group LLC

(57) ABSTRACT

A car coupling system for a rail vehicle includes a draft sill, and a crash energy management system disposed within the draft sill. The crash energy management system includes a first end plate, a second end plate, and a central tube disposed between the first end plate and the second end plate. The central tube is configured to deform in response to a force exerted into the car coupling system that exceeds a predetermined force threshold. Deformation of the central tube attenuates at least a portion of the force.

21 Claims, 5 Drawing Sheets

(56) References Cited

FOREIGN PATENT DOCUMENTS

| | | | | |
|---|---|---|---|---|
| GB | 2536888 A | * | 10/2016 | ..... B60R 19/34 |
| WO | WO 2005/023618 | | 3/2005 | |
| WO | WO 2012/067526 | | 5/2012 | |
| WO | WO 2019/240660 | | 12/2019 | |

OTHER PUBLICATIONS

Notification of Transmittal of the International Search Report and the Written Opinion of the Internal Searching Authority, or the Declaration for PCT/US2022/037665, dated Nov. 21, 2022.

* cited by examiner

CRASH ENERGY MANAGEMENT SYSTEMS FOR CAR COUPLING SYSTEMS OF RAIL CARS

FIELD OF THE DISCLOSURE

Embodiments of the present disclosure generally relate to coupling systems for rail vehicles, such as rail cars, and more particularly to car coupling systems having crash energy management systems.

BACKGROUND OF THE DISCLOSURE

Rail vehicles travel along railways, which have tracks that include rails. A rail vehicle includes one or more truck assemblies that support one or more car bodies.

When rail cars impact each other, longitudinal forces are exerted into car coupling systems thereof. If a maximum force limit is desired, energy attenuation devices can be used within the car coupling systems. A draft gear is such a device, but is usually limited with respect to forces that can be attenuated. However, when excessive forces are exerted into the car coupling system, there is a potential for damage to the car coupling systems.

SUMMARY OF THE DISCLOSURE

A need exists for a system and a method for attenuating energy exerted into a car coupling system. Further, a need exists for a system and a method that absorb energy that exceeds a predetermined force threshold. Moreover, a need exists for an efficient, effective, and low cost system for absorbing and attenuating such energy.

With those needs in mind, certain embodiments of the present disclosure provide a car coupling system for a rail vehicle. The car coupling system includes a draft sill, and a crash energy management system disposed within the draft sill. The crash energy management system includes a first end plate, a second end plate, and a central tube disposed between the first end plate and the second end plate. The central tube is configured to deform in response to a force exerted into the car coupling system that exceeds a predetermined force threshold. Deformation of the central tube attenuates at least a portion of the force.

In at least one embodiment, a coupler extends outwardly from a first end of the draft sill. Further, a first stop is within the draft sill. A draft gear having a yoke is also within the draft sill. The coupler connects to the draft gear. Additionally, a second stop is within the draft sill. In at least one embodiment, the crash energy management system is disposed between the draft gear and the second stop.

As an example, the crash energy management system is formed of steel.

In at least one embodiment, the central tube has a length, an outer diameter, and a wall thickness. A ratio of the length to the outer diameter is 2:1, and a ratio of the outer diameter to the wall thickness is 8:1.

In at least one embodiment, the crash energy management system further includes a supplemental tube within an internal chamber of the central tube. As an example, the supplemental tube has a length, an outer diameter, and a wall thickness. A ratio of the length to the outer diameter is 2:1, and a ratio of the outer diameter to the wall thickness is 8:1. In at least one embodiment, the supplemental tube is coaxial with the central tube.

In at least one embodiment, the crash energy management system further include one or more supplemental tubes outside of the central tube.

Certain embodiments of the present disclosure provide a method of forming a car coupling system for a rail vehicle. The method includes disposing a crash energy management system within a draft sill, as described herein.

DETAILED DESCRIPTION OF THE DISCLOSURE

The foregoing summary, as well as the following detailed description of certain embodiments, will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular condition may include additional elements not having that condition.

Embodiments of the present disclosure provide a crash energy management system for a coupling system of a rail vehicle. The crash energy management system can be used in series with a draft gear to attenuate energy above and beyond that which a typical draft gear is configured to handle, thereby keeping a peak force below a desired limit. In at least one embodiment, the crash energy management system includes a canister with flanges at each end. When force that exceeds a predetermined force threshold is exerted into the coupling system, the crash energy management system plastically deforms (such as via concertina buckling), and strokes a prescribed distance while managing the energy and force during the impact. In at least one embodiment, the crash energy management system is akin to a mechanical fuse. Once deformed, the crash energy management system may be unable to return to a non-deformed state. As such, the crash energy management system may not be reused after deformation.

Figure 1:
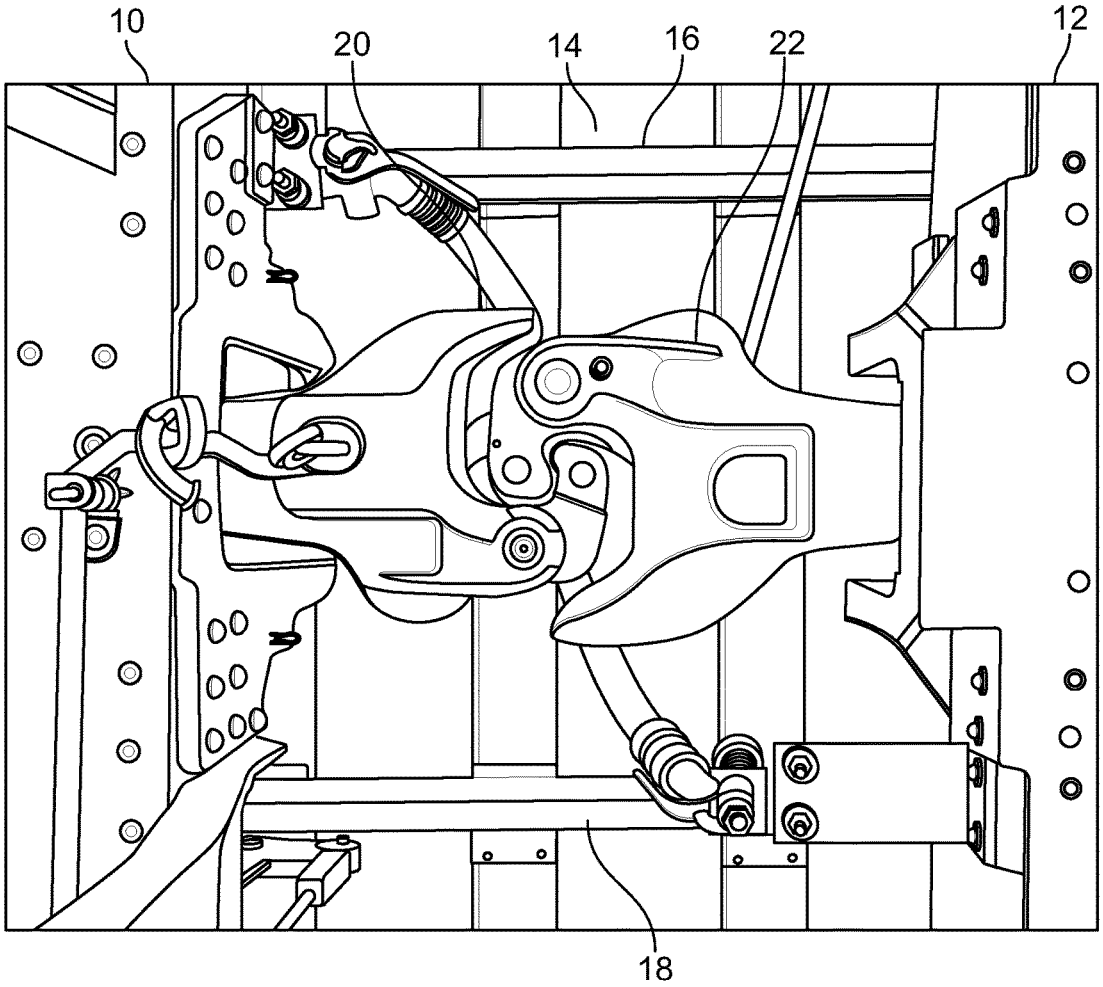
FIG. 1 illustrates a top view of a first rail car coupled to a second rail car.

FIG. 1 illustrates a top view of a first rail car 10 coupled to a second rail car 12. The first rail car 10 and the second rail car 12 are configured to travel along a track 14 having rails 16 and 18. A coupler 20 of the first rail car 10 connects to a coupler 22 of the second rail car 12.

Figure 2:
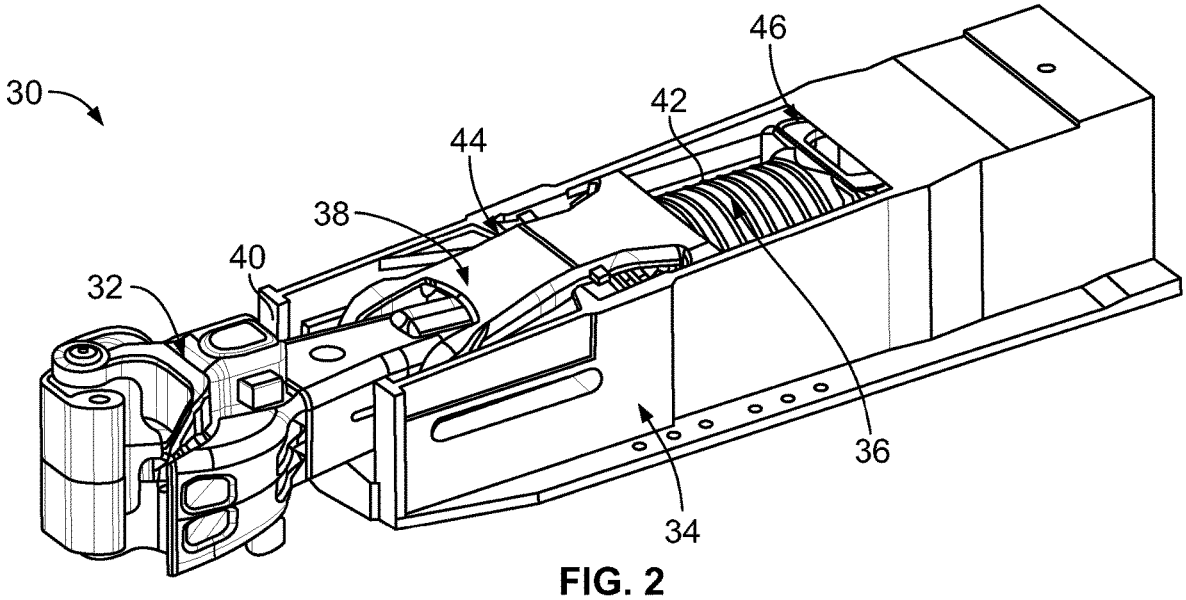
FIG. 2 illustrates a perspective top view of a car coupling system.

FIG. 2 illustrates a perspective top view of a car coupling system 30. The first rail car 10 and the second rail car 12 include a car coupling system 30. The car coupling system 30 includes a coupler 32 (such as the coupler 20 or the coupler 22 shown in FIG. 1), a draft sill 34, and a draft gear 36 with yoke 38. The coupler 32 is supported at a first end 40 by the draft sill 34 and at an opposite second end 42 by the draft gear 36 or cushion unit with the yoke 38. The draft gear 36 or cushion unit is constrained within the draft sill 34 by a pair of front stops 44 and a pair of rear stops 46.

Figure 3:
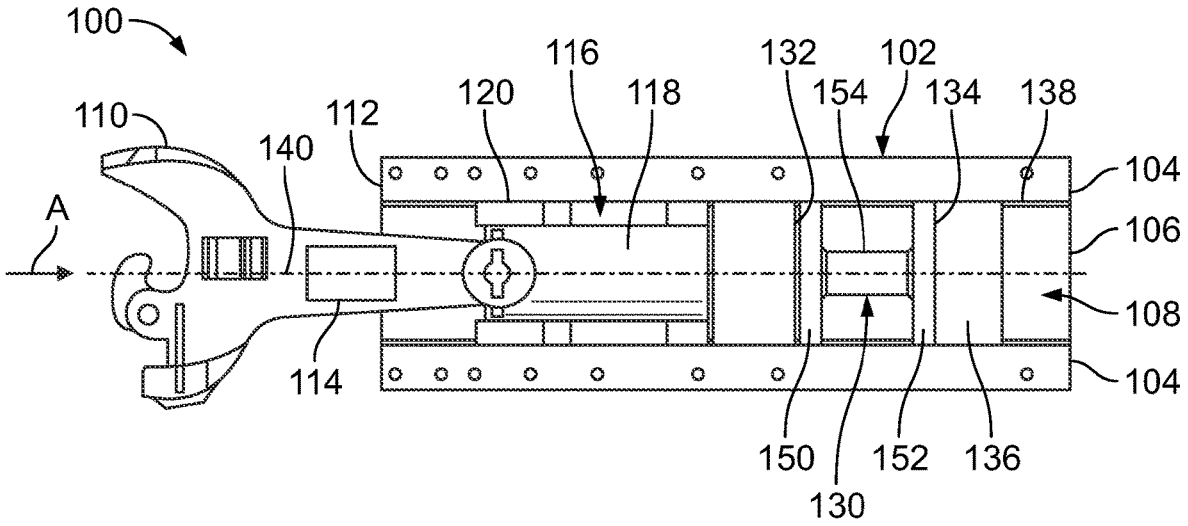
FIG. 3 illustrates a bottom view of a car coupling system, according to an embodiment of the present disclosure.
Figure 4:
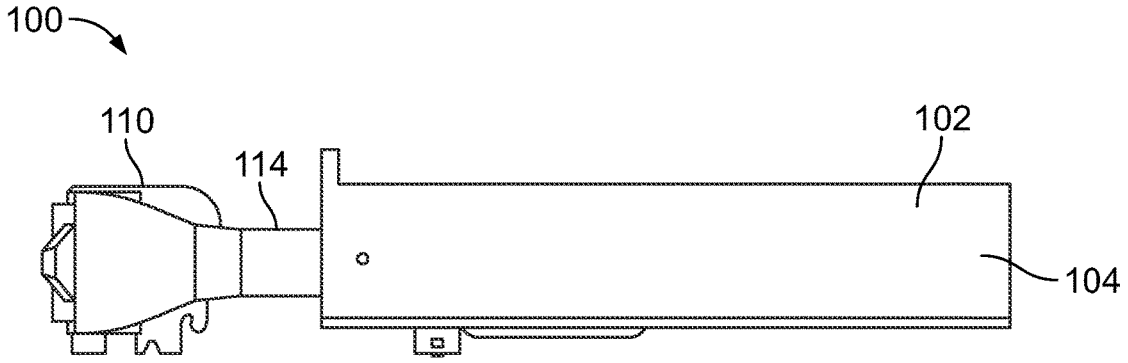
FIG. 4 illustrates a lateral view of the car coupling system of FIG. 3.

FIG. 3 illustrates a bottom view of a car coupling system 100, according to an embodiment of the present disclosure. FIG. 4 illustrates a lateral view of the car coupling system 100 of FIG. 3. Referring to FIGS. 3 and 4, the car coupling system 100 includes a draft sill 102 including lateral walls 104 connected to a top wall 106. A chamber 108 is defined between the lateral walls 104 and the top wall 106. A carrier plate secures to the lateral walls 104 opposite from the top wall 106. For the sake of clarity, the carrier plate is not shown.

A coupler 110 extends outwardly from a first end 112 (for example, a fore end) of the draft sill 102. A shank 114 of the coupler 110 extends into the chamber 108 and connects to a draft gear 116. The draft gear 116 includes a yoke 118. A first stop 120 is secured to internal portions of the draft sill 102. At least a portion of the draft gear 116 is disposed behind (that is, further from the first end 112) the first stop 120.

A crash energy management system 130 is disposed within the draft sill 102 between an aft end 132 of the draft gear 116 and a fore end 134 of a second stop 136, which is proximate to a second end 138 (for example, an aft end) of the draft sill 102. The crash energy management system 130 is longitudinally aligned with the draft gear 116. For example, the crash energy management system 130 and the draft gear 116 are longitudinally aligned along a central longitudinal axis 140 of the car coupling system 100.

In at least one embodiment, the crash energy management system 130 is aligned in series between the draft gear 116 and the second stop 136. As shown, the crash energy management system 130 is disposed behind the draft gear 116 and in front of the second stop 136.

As described herein, the crash energy management system 130 provides a mechanical fuse that is configured to deform when a force exceeding a predetermined force threshold is exerted into the car coupling system 100 in the direction of arrow A, for example. By deforming in response to the force in the direction of arrow A that exceeds a predetermined force threshold, the crash energy management system 130 attenuates and absorbs at least a portion of the force, thereby ensuring that other components of the car coupling system 100 and associated rail car are not subjected to the peak force. In this manner, the crash energy management system 130 prevents or otherwise reduces potential damage to the car coupling system 100 and the rail car.

Figure 5:
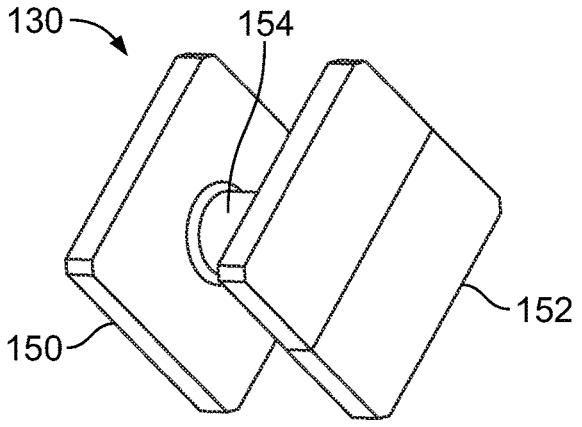
FIG. 5 illustrates a perspective view of a crash energy management system, according to an embodiment of the present disclosure.

FIG. 5 illustrates a perspective view of the crash energy management system 130, according to an embodiment of the present disclosure. In at least one embodiment, the crash energy management system 130 is formed of a metal, such as steel aluminum, or the like. As another example, the crash energy management system 130 can be formed of a plastic, such as resin. As another example, the crash energy management system 130 can be formed of metal and plastic.

The crash energy management system 130 includes a first end plate 150 connected to a second end plate 152 by a central tube 154 (for example, a canister). Referring to FIGS. 3 and 5, the first end plate 150 abuts against the aft end 132 of the draft gear 116, and the second end plate 152 abuts against the fore end 134 of the second stop 136. The first end plate 150 may be secured to the aft end 132 through one or more fasteners, adhesives, and/or the like. Similarly, the second end plate 152 may be secured to the fore end 134 through one or more fasteners, adhesives, and/or the like. In at least one other embodiment, the first end plate 150 and the second end plate 152 are not fastened or otherwise fixed to the aft end 132 and the fore end 134, respectively, with fasteners and/or adhesives.

Figure 6:
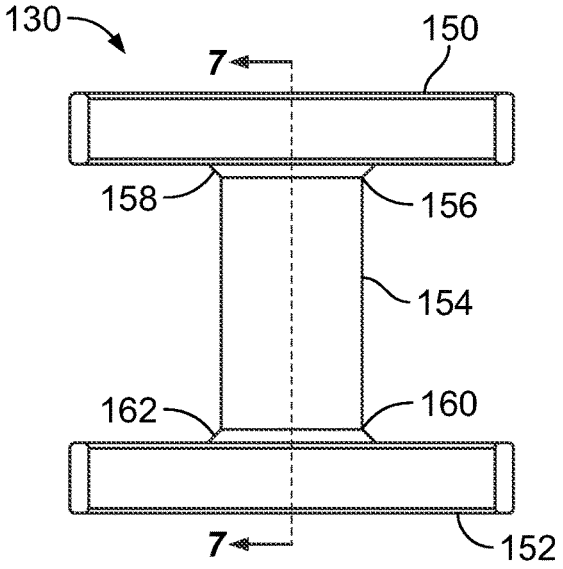
FIG. 6 illustrates a lateral view of the crash energy management system of FIG. 5.

FIG. 6 illustrates a lateral view of the crash energy management system 100 of FIG. 5. In at least one embodiment, the central tube 154 has a circular axial cross-section. A first end 156 of the central tube 154 can be secured to the first end plate 150 at a weld line 158. Similarly, a second end 160 of the central tube 154 can be secured to the second end plate 152 at a weld line 162.

Figure 7:
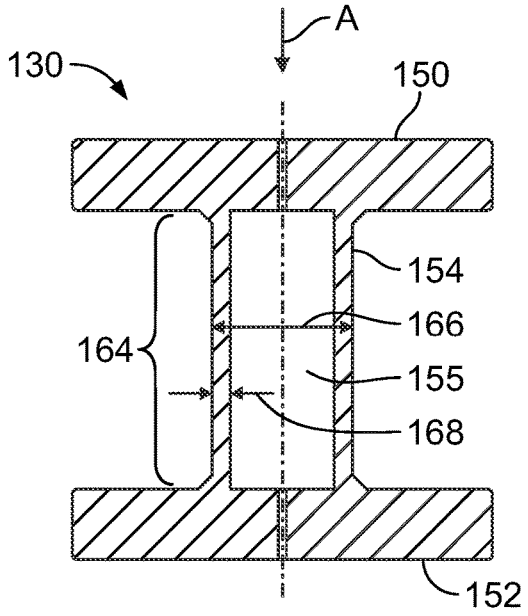
FIG. 7 illustrates a cross-sectional view of the crash energy management system through line 7-7 of FIG. 6.

FIG. 7 illustrates a cross-sectional view of the crash energy management system 130 through line 7-7 of FIG. 6. In at least one embodiment, the central tube 154 is hollow, having an internal chamber 155. The central tube 154 includes a length 164, an outer diameter 166, and a wall thickness 168. In order to achieve concertina buckling upon deformation (in response to experiencing force in the direction of arrow A), the ratio of the length 164 to outer diameter 166 is 2:1. For example, the length 164 can be 8 inches, and the outer diameter 166 is 4 inches. Optionally, the length 164 can be greater or less than 8 inches, and the outer diameter 166 can be greater or less than 4 inches. For example, the length 164 can be 4 inches, and the outer diameter 166 can be 2 inches.

Further, in order to achieve concertina buckling, the ratio of the outer diameter 166 to the wall thickness 168 is 8:1. For example, the outer diameter is 4 inches, and the wall thickness 168 is 0.5 inches. Optionally, the outer diameter 166 can be greater or less than 4 inches, and the wall thickness 168 can be greater or less than 0.5 inch. For example, the outer diameter 166 can be 8 inches, and the wall thickness 168 can be 1 inch.

Plastic deformation of the central tube 154 via concertina buckling is desirable as it exhibits an ideal force travel curve. As noted, in order to ensure concertina buckling, the ratio of the length 164 to the outer diameter 166 is 2:1, while the ratio of the outer diameter 166 to the wall thickness 168 is 8:1. Alternatively, the outer tube 154 can be sized and shaped differently so as not to provide concertina buckling.

Figure 8:
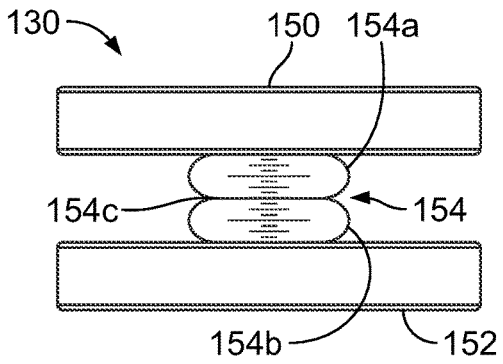
FIG. 8 illustrates a lateral view of the crash energy management system in a deformed state, according to an embodiment of the present disclosure.

FIG. 8 illustrates a lateral view of the crash energy management system 130 in a deformed state, according to an embodiment of the present disclosure. Referring to FIGS. 3-8, when a force that exceeds a predetermined force threshold is exerted into the car coupling system 100 in the direction of arrow A, the central tube 154 deforms, thereby absorbing and attenuating the energy of the force. As shown in FIG. 8, the deformation occurs as concertina buckling, in which the central tube 154 deforms into a first axially compressed and radially expanded bulge 154*a* separated from a second axially compressed and radially expanded bulge 154*b* by an intermediate seam 154*c*.

Referring to FIGS. 1-8, the car coupling system 100 for a rail vehicle includes the draft sill 102, and the crash energy management system 130 disposed within the draft sill 102. The crash energy management system 130 includes the first end plate 150, the second end plate 152, and the central tube 154 disposed between the first end plate 150 and the second end plate 152. The central tube 154 is configured to deform in response to a force exerted into the car coupling system 100 that exceeds a predetermined force threshold. Deformation of the central tube 154 attenuates at least a portion of the force.

Figure 9:
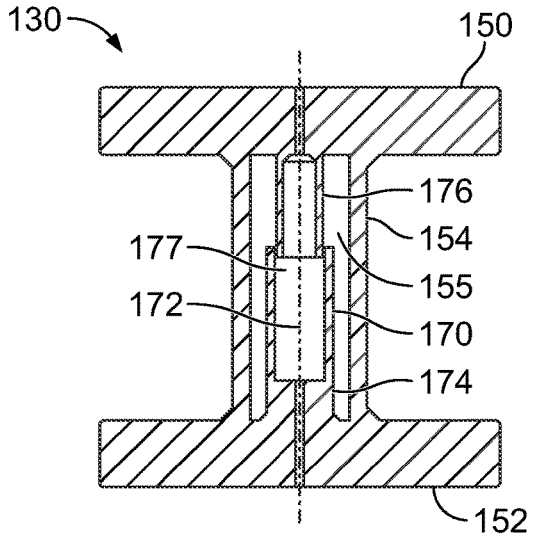
FIG. 9 illustrates a cross-sectional view of the crash energy management system through line 7-7 of FIG. 6, according to an embodiment of the present disclosure.

FIG. 9 illustrates a cross-sectional view of the crash energy management system 130 through line 7-7 of FIG. 6, according to an embodiment of the present disclosure. Depending on the amount of energy attenuation desired, a supplemental tube 170 can be disposed within the internal chamber 155 of the central tube 154. In at least one embodiment, the supplemental tube 170 is coaxial with the central tube 154. For example, the central tube 154 and the supplemental tube 170 are coaxial with a central longitudinal axis 172 of the crash energy management system 130.

In at least one embodiment, the supplemental tube 170 is a half scale of the central tube 154. In order to achieve concertina buckling upon deformation, the central tube 154 and the supplemental tube 170 are both sided and shaped to have a length to outer diameter ratio of 2:1, and an outer diameter to wall thickness ratio of 8:1. As a non-limiting example, the central tube 150 has a length of 8 inches, an outer diameter of 4 inches, and a wall thickness of 0.5 inches, while the supplemental tube 170 has a length of 4 inches, an outer diameter of 2 inches, and a wall thickness of 0.25 inches.

In at least one embodiment, the supplemental tube 170 extends from a pedestal 174 that extends from the second end plate 152. The supplemental tube 170 connects to a guide tube 176 that extends from the first end plate 150 into a central chamber 177 of the supplemental tube 170. The guide tube 176 ensures that the supplemental tube 170 remains longitudinally aligned as the central tube 154 deforms.

During deformation, as the central tube 154 deforms, the supplemental tube 170 is urged toward the first end plate 150 and is aligned by the guide tube 176. As the supplemental tube 170 abuts against the first end plate 150, the supplemental tube 170 deforms similar to the central tube 154, as described herein.

The addition of the supplemental tube 170 provides additional deformation and energy attenuation. Deformation of the supplemental tube 170 provides additional concertina buckling, for example, that provides a smoother and more desirable force travel curve.

Figure 10:
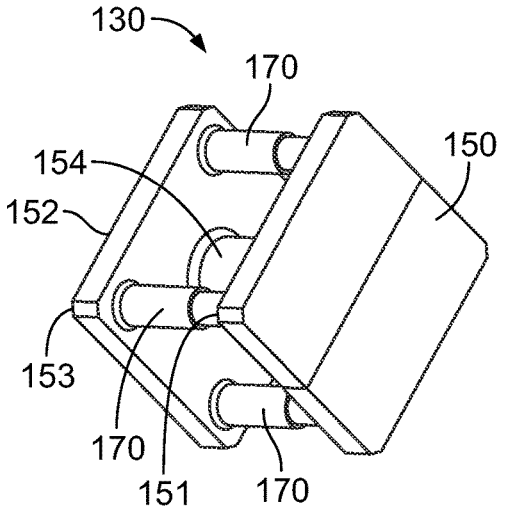
FIG. 10 illustrates a perspective view of a crash energy management system, according to an embodiment of the present disclosure.
Figure 11:
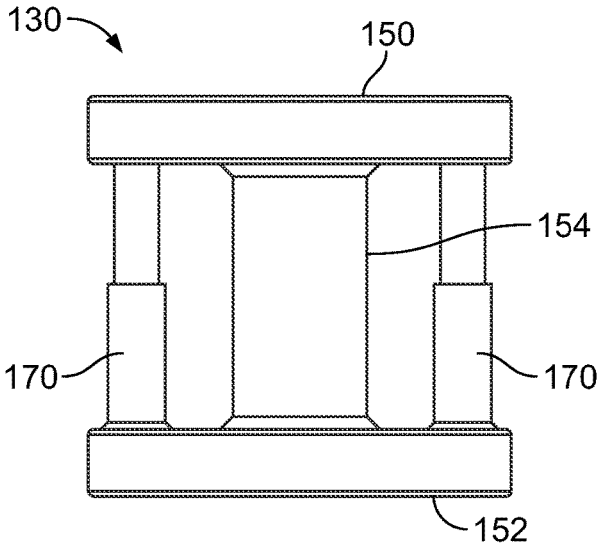
FIG. 11 illustrates a lateral view of the crash energy management system of FIG. 10.

FIG. 10 illustrates a perspective view of the crash energy management system 130, according to an embodiment of the present disclosure. FIG. 11 illustrates a lateral view of the crash energy management system 130 of FIG. 10. In this embodiment, depending on the amount of energy attenuation desired, supplemental tubes 170, as described with respect to FIG. 9, can be disposed at corners of the crash energy management system 130. For example, an exterior supplemental tube 170 can be disposed between a first corner 151 of the first end plate 150, and a first corner 153 of the second end plate 152. Each supplemental tube 170 is parallel to the central tube 154. As shown, the crash energy management system 130 can include four supplemental tubes 170.

The supplemental tubes 170 are exterior in that each is not disposed within the central tube 154. The central tube 154 may also include a supplemental tube 170 disposed therein, as described with respect to FIG. 9. The crash energy management system 130 can include more or less supplemental tubes 170 than shown. For example, the crash energy management system 130 can include two supplemental tubes 170 in addition to the central tube 154.

Referring to FIGS. 9-11, in at least one embodiment, the supplemental tubes 170 are sized, shaped, and configured to activate (for example, initiate deformation) such that the ensuring deformation contributes to help smooth an overall force vs. travel curve. The main, central tube 154 may deform and cause one or more aberrations (for example, dips) in the curve. The supplemental tubes 170 are configured to fill in such aberrations.

Figure 12:
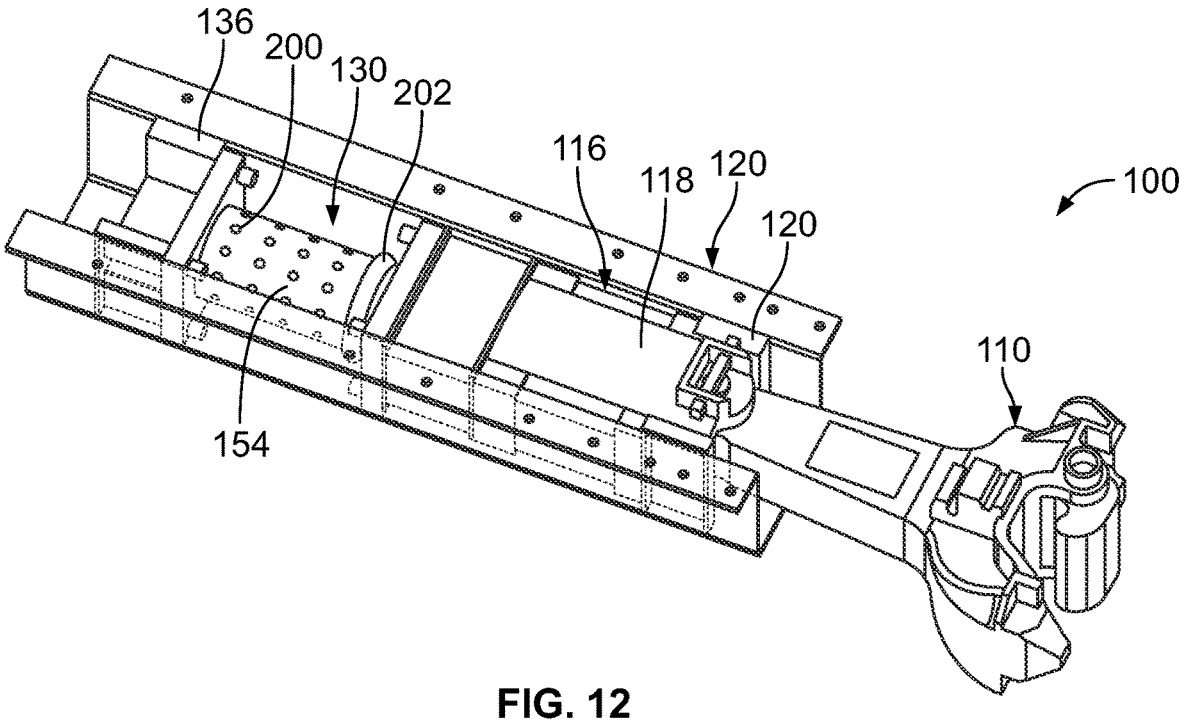
FIG. 12 illustrates a perspective bottom view of a car coupling system, according to an embodiment of the present disclosure.

FIG. 12 illustrates a perspective bottom view of the car coupling system 100, according to an embodiment of the present disclosure. As shown, the crash energy management system 130 can include one or more indentations, recesses, or channels 200 formed therein or therethrough, such as through the central tube 154. Further, the crash energy management system 130 can include one or more radial rims 202 radially extending from an outer surface of the central tube 154.

Figure 13:
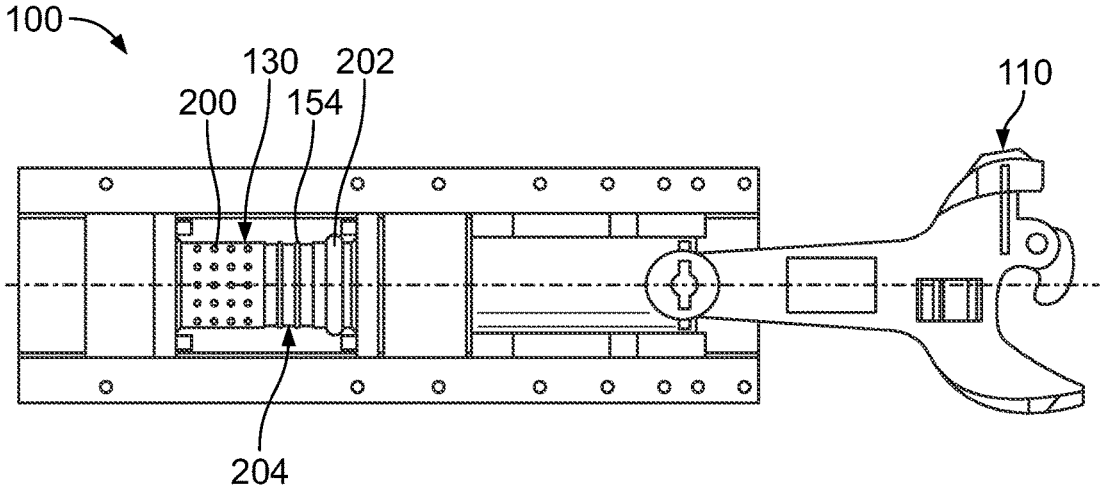
FIG. 13 illustrates a bottom view of a car coupling system, according to an embodiment of the present disclosure.

FIG. 13 illustrates a bottom view of a car coupling system 100, according to an embodiment of the present disclosure. The crash energy management system 130 can include one or more annular recesses 204 formed into the central tube 154.

Referring to FIGS. 3-13, various materials can be used to form the crash energy management system 130 depending on a desired force threshold upon which the crash energy management system 130 is to deform. For example, the crash energy management system 130 can be formed of steel, aluminum, or various other metals. Additionally, the crash energy management system 130 can be sized and shaped for concertina buckling, as described herein, to provide an ideal energy attenuator. Moreover, a material having a particular yield strength, elongation characteristics, and/or the like can be chosen depending on the desired force threshold.

In at least one embodiment, mechanical properties such as yield strength, tensile strength, and elongation may be used to tune deformation of the crash energy management system 130 (such as the main central tube 154 and/or any supplemental tubes 170), as desired, such as to achieve specified trigger forces and curve quality. Further, in at least one embodiment, components of the crash energy management system 130 (such as the main central tube 154 and/or any supplemental tubes 170) can be pre-deformed, such as to provide stability and desired deformation triggering.

Certain embodiments of the present disclosure provide a method of forming a car coupling system for a rail vehicle. The method includes disposing a crash energy management system within a draft sill. The crash energy management system includes a first end plate, a second end plate, and a central tube disposed between the first end plate and the second end plate. The central tube is configured to deform in response to a force exerted into the car coupling system that exceeds a predetermined force threshold. Deformation of the central tube attenuates at least a portion of the force.

In at least one embodiment, the method further includes extending a coupler outwardly from a first end of the draft sill, disposing a first stop within the draft sill, disposing a draft gear having a yoke within the draft sill. connecting the coupler to the draft gear, and disposing a second stop within the draft sill, wherein the crash energy management system is disposed between the draft gear and the second stop.

As a further example, the method includes disposing a supplemental tube within an internal chamber of the central tube. As another or further example, the method includes disposing one or more supplemental tubes outside of the central tube.

Further, the disclosure comprises embodiments according to the following clauses:

Clause 1. A car coupling system for a rail vehicle, the car coupling system comprising:

a draft sill; and a crash energy management system disposed within the draft sill, wherein the crash energy management system comprises:

a first end plate;

a second end plate; and a central tube disposed between the first end plate and the second end plate, wherein the central tube is configured to deform in response to a force exerted into the car coupling system that exceeds a predetermined force threshold, and wherein deformation of the central tube attenuates at least a portion of the force.

Clause 2. The car coupling system of Clause 1, further comprises a coupler extending outwardly from a first end of the draft sill.

Clause 3. The car coupling system of Clause 2, further comprising:

a first stop within the draft sill; and a draft gear having a yoke within the draft sill, wherein the coupler connects to the draft gear.

Clause 4. The car coupling system of Clause 3, further comprising a second stop within the draft sill, wherein the crash energy management system is disposed between the draft gear and the second stop.

Clause 5. The car coupling system of any of Clauses 1-4, wherein the crash energy management system is formed of steel.

Clause 6. The car coupling system of any of Clauses 1-5, wherein the central tube has a length, an outer diameter, and a wall thickness, wherein a ratio of the length to the outer diameter is 2:1, and wherein a ratio of the outer diameter to the wall thickness is 8:1.

Clause 7. The car coupling system of any of Clauses 1-6, wherein the crash energy management system further comprises a supplemental tube within an internal chamber of the central tube.

Clause 8. The car coupling system of Clause 7, wherein the supplemental tube has a length, an outer diameter, and a wall thickness, wherein a ratio of the length to the outer diameter is 2:1, and wherein a ratio of the outer diameter to the wall thickness is 8:1.

Clause 9. The car coupling system of Clauses 7 or 8, wherein the supplemental tube is coaxial with the central tube.

Clause 10. The car coupling system of any of Clauses 1-9, wherein the crash energy management system further comprises one or more supplemental tubes outside of the central tube.

Clause 11. A method of forming a car coupling system for a rail vehicle, the method comprising:

disposing a crash energy management system within a draft sill, wherein the crash energy management system comprises:

a first end plate;

a second end plate; and a central tube disposed between the first end plate and the second end plate, wherein the central tube is configured to deform in response to a force exerted into the car coupling system that exceeds a predetermined force threshold, and wherein deformation of the central tube attenuates at least a portion of the force.

Clause 12. The method of Clause 11, further comprising:

extending a coupler outwardly from a first end of the draft sill;

disposing a first stop within the draft sill;

disposing a draft gear having a yoke within the draft sill;

connecting the coupler to the draft gear; and disposing a second stop within the draft sill, wherein the crash energy management system is disposed between the draft gear and the second stop.

Clause 13. The method of Clauses 11 or 12, wherein the central tube has a length, an outer diameter, and a wall thickness, wherein a ratio of the length to the outer diameter is 2:1, and wherein a ratio of the outer diameter to the wall thickness is 8:1.

Clause 14. The method of any of Clauses 11-13, further comprising disposing a supplemental tube within an internal chamber of the central tube.

Clause 15. The method of Clause 14, wherein the supplemental tube has a length, an outer diameter, and a wall thickness, wherein a ratio of the length to the outer diameter is 2:1, and wherein a ratio of the outer diameter to the wall thickness is 8:1.

Clause 16. The method of any of Clauses 11-15, further comprising disposing one or more supplemental tubes outside of the central tube.

Clause 17. A car coupling system for a rail vehicle, the car coupling system comprising:

a draft sill;

a coupler extending outwardly from a first end of the draft sill;

a first stop within the draft sill;

a draft gear having a yoke within the draft sill, wherein the coupler connects to the draft gear;

a second stop within the draft sill; and a crash energy management system disposed between the draft gear and the second stop within the draft sill, wherein the crash energy management system comprises:

a first end plate;

a second end plate; and a central tube disposed between the first end plate and the second end plate, wherein the central tube is configured to deform in response to a force exerted into the car coupling system that exceeds a predetermined force threshold, wherein deformation of the central tube attenuates at least a portion of the force, wherein the central tube has a length, an outer diameter, and a wall thickness, wherein a ratio of the length to the outer diameter is 2:1, and wherein a ratio of the outer diameter to the wall thickness is 8:1.

Clause 18. The car coupling system of Clause 17, wherein the crash energy management system is formed of steel.

Clause 19. The car coupling system of Clauses 17 or 18, wherein the crash energy management system further comprises a supplemental tube within an internal chamber of the central tube, wherein the supplemental tube has a length, an outer diameter, and a wall thickness, wherein a ratio of the length to the outer diameter is 2:1, and wherein a ratio of the outer diameter to the wall thickness is 8:1.

Clause 20. The car coupling system of any of Clauses 17-19, wherein the crash energy management system further comprises one or more supplemental tubes outside of the central tube.

As described herein, embodiments of the present disclosure provide systems and methods for attenuating energy exerted into a car coupling system. Further, embodiments of the present disclosure provide systems and methods that absorb energy that exceeds a predetermined force threshold. Moreover, embodiments of the present disclosure provide efficient, effective, and low cost systems for absorbing and attenuating such energy.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed:

1. A car coupling system for a rail vehicle, the car coupling system comprising:
- a draft sill;
- a first stop within the draft sill;
- a second stop within the draft sill;
- a draft gear having a yoke within the draft sill; and
- a crash energy management system disposed between the draft gear and the second stop within the draft sill, wherein the crash energy management system comprises:
  - a first end plate abutting against a rear face of an aft end of the draft gear;
  - a second end plate abutting against a front face of a fore end of the second stop;
  - a central tube disposed between the first end plate and the second end plate, wherein the central tube has a first end secured to the first end plate, and a second end secured to the second end plate, wherein the central tube is configured to deform in response to a force exerted into the car coupling system that exceeds a predetermined force threshold, and wherein deformation of the central tube attenuates at least a portion of the force; and
  - a supplemental tube within an internal chamber of the central tube.

2. The car coupling system of claim 1, further comprising a coupler extending outwardly from a first end of the draft sill, wherein the coupler connects to the draft gear.

3. The car coupling system of claim 1, wherein the crash energy management system is formed of steel.

4. The car coupling system of claim 1, wherein the central tube has a length, an outer diameter, and a wall thickness, wherein a ratio of the length to the outer diameter is 2:1, and wherein a ratio of the outer diameter to the wall thickness is 8:1.

5. The car coupling system of claim 1, wherein the supplemental tube has a length, an outer diameter, and a wall thickness, wherein a ratio of the length to the outer diameter is 2:1, and wherein a ratio of the outer diameter to the wall thickness is 8:1.

6. The car coupling system of claim 1, wherein the supplemental tube is coaxial with the central tube.

7. The car coupling system of claim 1, wherein the crash energy management system further comprises one or more supplemental tubes outside of the central tube.

8. A method of forming a car coupling system for a rail vehicle, the method comprising:
- disposing a first stop within a draft sill;
- disposing a draft gear having a yoke within the draft sill;
- disposing a second stop within the draft sill;
- disposing a crash energy management system between the draft gear and the second stop within the draft sill, wherein the crash energy management system comprises:
  - a first end plate abutting against a rear face of an aft end of the draft gear;
  - a second end plate abutting against a front face of a fore end of the second stop; and a central tube disposed between the first end plate and the second end plate, wherein the central tube has a first end secured to the first end plate, and a second end secured to the second end plate, wherein the central tube is configured to deform in response to a force exerted into the car coupling system that exceeds a predetermined force threshold, and wherein deformation of the central tube attenuates at least a portion of the force; and disposing a supplemental tube within an internal chamber of the central tube.

9. The method of claim 8, further comprising:

extending a coupler outwardly from a first end of the draft sill; and connecting the coupler to the draft gear.

10. The method of claim 8, wherein the central tube has a length, an outer diameter, and a wall thickness, wherein a ratio of the length to the outer diameter is 2:1, and wherein a ratio of the outer diameter to the wall thickness is 8:1.

11. The method of claim 8, wherein the supplemental tube has a length, an outer diameter, and a wall thickness, wherein a ratio of the length to the outer diameter is 2:1, and wherein a ratio of the outer diameter to the wall thickness is 8:1.

12. The method of claim 8, further comprising disposing one or more supplemental tubes outside of the central tube.

13. A car coupling system for a rail vehicle, the car coupling system comprising:

a draft sill;

a coupler extending outwardly from a first end of the draft sill;

a first stop within the draft sill;

a draft gear having a yoke within the draft sill, wherein the coupler connects to the draft gear;

a second stop within the draft sill; and a crash energy management system disposed between the draft gear and the second stop within the draft sill, wherein the crash energy management system comprises:

a first end plate abutting against a rear face of an aft end of the draft gear;

a second end plate abutting against a front face of a fore end of the second stop;

a central tube disposed between the first end plate and the second end plate, wherein the central tube has a first end secured to the first end plate, and a second end secured to the second end plate, wherein the central tube is configured to deform in response to a force exerted into the car coupling system that exceeds a predetermined force threshold, wherein deformation of the central tube attenuates at least a portion of the force, wherein the central tube has a length, an outer diameter, and a wall thickness, and wherein a ratio of the length to the outer diameter is 2:1, and wherein a ratio of the outer diameter to the wall thickness is 8:1; and a supplemental tube within an internal chamber of the central tube.

14. The car coupling system of claim 13, wherein the crash energy management system is formed of steel.

15. The car coupling system of claim 13, wherein the supplemental tube has a length, an outer diameter, and a wall thickness, wherein a ratio of the length to the outer diameter is 2:1, and wherein a ratio of the outer diameter to the wall thickness is 8:1.

16. The car coupling system of claim 13, wherein the crash energy management system further comprises one or more supplemental tubes outside of the central tube.

17. The car coupling system of claim 1, wherein the first end is secured to the first end plate at a first weld line, and the second end is secured to the second end plate at a second weld line.

18. The method of claim 8, wherein the first end is secured to the first end plate at a first weld line, and the second end is secured to the second end plate at a second weld line.

19. The car coupling system of claim 12, wherein the first end is secured to the first end plate at a first weld line, and the second end is secured to the second end plate at a second weld line.

20. The car coupling system of claim 1, wherein the first end plate is secured to the rear face of the aft end of the draft gear.

21. The car coupling system of claim 20, wherein the second end plate is secured to the front face of the fore end of the second stop.

* * * * *